US006413368B1

(12) United States Patent
Dwiggins et al.

(10) Patent No.: US 6,413,368 B1
(45) Date of Patent: Jul. 2, 2002

(54) FOAM FORMING METHOD AND APPARATUS

(75) Inventors: John Henry Dwiggins; Dinesh M. Bhat, both of Neenah, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 08/248,543

(22) Filed: May 24, 1994

Related U.S. Application Data

(63) Continuation of application No. 07/599,149, filed on Oct. 17, 1990, now abandoned.

(51) Int. Cl.[7] ..... D21F 1/00

(52) U.S. Cl. ..... 162/101; 162/190; 162/198; 162/262; 162/263; 162/264; 162/DIG. 11

(58) Field of Search ..... 162/101, 190, 162/198, 262, 263, 264, DIG. 11

(56) References Cited

U.S. PATENT DOCUMENTS

| | | | | |
|---|---|---|---|---|
| 3,326,745 A | | 6/1967 | Graham | |
| 3,619,360 A | * | 11/1971 | Persik | 162/198 |
| 3,716,449 A | * | 2/1973 | Gatward et al. | 162/101 |
| 3,746,613 A | | 7/1973 | Vauhkonen | |
| 3,806,406 A | | 4/1974 | Ely | |
| 3,837,999 A | | 9/1974 | Chung | |
| 3,846,232 A | | 11/1974 | Kankaanpaa | |
| 3,871,952 A | | 3/1975 | Robertson | 162/101 |
| 3,876,498 A | | 4/1975 | Justus | |
| 3,937,273 A | | 2/1976 | Radvan et al. | 162/212 |
| 3,938,782 A | | 2/1976 | Robertson | 259/4 R |
| 3,947,315 A | | 3/1976 | Smith | |
| 4,062,721 A | | 12/1977 | Guyer et al. | |
| 4,443,297 A | * | 4/1984 | Cheshire et al. | 162/101 |
| 4,443,299 A | | 4/1984 | Cheshire et al. | 162/264 |
| 4,488,932 A | | 12/1984 | Eber et al. | 162/9 |
| 4,498,956 A | | 2/1985 | Cheshire et al. | 162/101 |
| 4,543,156 A | | 9/1985 | Cheshire et al. | 162/101 |
| 4,686,006 A | | 8/1987 | Cheshire et al. | 162/336 |
| 4,764,253 A | * | 8/1988 | Cheshire et al. | 162/198 |
| 4,869,782 A | | 9/1989 | Nelson et al. | 162/9 |

OTHER PUBLICATIONS

"Sheet Formation & Printability," by B. Radvan et al, presented at the 14th EUCEPA Conference in Oct., 1971.

"Wet–Laid, Long Fiber Formers," by A.P.J. Gatward, published in *Paper Technology*, vol. 13, No. 4, dated Aug., 1972.

"The Structure and Properties of Paper Formed by a Foaming Process," by M. K. Smith et al, *TAPPI*, vol. 57, No. 1, Jan., 1974.

"Long–Fibre Developments in U.K. & Europe," by A.P.J. Gatward, published in *Paper Technology*, vol. 14, No. 5, Oct., 1973.

"New Developments in the Radfoam Process," by R. W. Tringham, published in *Paper Technology*, Oct., 1974, vol. 15, No. 5, pp. 288–294.

* cited by examiner

*Primary Examiner*—Peter Chin
(74) *Attorney, Agent, or Firm*—Finnegan, Henderson, Farabow, Garrett, and Dunner, L.L.P.

(57) ABSTRACT

Apparatus and process for producing foam formed fibrous web in which the furnish is made up by mixing a thin water slurry of fibers at a consistency in the range of from about 0.5 to about 7 weight percent fibers with sufficient aqueous foam containing a surfactant and having an air content in the range of from about 55 to about 80 percent by volume to form a foamed fiber furnish containing from about 0.1 to about 3 weight percent fibers which is supplied directly to the forming felt or wire of a twin wire papermaking machine, adding makeup surfactant and discarding excess aqueous foam from the process as required to maintain the desired volume of foamed liquid therein.

9 Claims, 2 Drawing Sheets

PULP
SURFACTANT
FOAM

46'
W
16'
11'
20'
40'
24'
22'
12'
32b'
38'
39'
41'
42'
43'
37'
PULP
36'
47'
30'
SURFACTANT
31'
32
32a'
24'
34'
33'
FOAM

FOAM FORMING METHOD AND APPARATUS

This application is a continuation, of application Ser. No. 07/599,149 filed on Oct. 17, 1990, now abandoned.

This invention relates to an improved foam forming process and apparatus for the manufacture of high quality fibrous webs. In one of its more specific aspects it relates to an improved method and apparatus for preparing low basis weight webs of exceptionally high uniformity, particularly tissue suitable for use as facial tissue and bathroom tissue, and in personal hygiene products.

Foam forming processes for tissue manufacture are known in the art. Among the prior art processes for producing webs by various foam forming methods are those disclosed in U.S. Pat. Nos. 3,716,449; 3,938,782; 3,871,952; and 3,837,999. These prior art patents have in common the teaching of separate foamed liquid generating systems wherein liquid containing a surface active agent is subjected to turbulence in the presence of air to create foamed liquid as carrier fluid for making up a foamed fiber furnish.

U.S. Pat. Nos. 3,876,498; 3,846,232; 4,062,721; and 3,746,613, and 4,543,156 incorporated herein by reference, disclose preferred papermaking machines useful in the process of this invention.

In a preferred embodiment of the invention, the fibrous web forming apparatus is either a papermaking machine known in the art as a crescent former or one of the twin wire type, as described in U.S. Pat. No. 4,543,156 wherein one of the forming wires acts as a turbulence generator producing the foamed liquid in which fibers are dispersed to make up the foamed fiber furnish. In these machines, foamed liquid is generated at the forming wire without the need for separate turbulence generating devices. Control of the foamed liquid as to desired air content, viscosity, specific gravity, and related characteristics is accomplished without the need for special foam generators.

U.S. Pat. Nos. 4,443,299 and 4,543,156, incorporated herein by reference, disclose processes for foam forming fibrous webs in which the foamed liquid is produced on the forming wires, stored in a silo, and totally recycled to minimize loss of surfactant from the system. In order to achieve this objective, it is necessary to dewater the wet feed pulp to a consistency in the range of 8 to 50 weight percent fiber, preferably in the range of 15 to 35 weight percent fiber, prior to formation of the desired foam and fiber furnish. Dispersion of the high consistency stock in foam in prior art has required a separate foam loop which has mixing equipment capable of relatively high shear mixing to form the desired foamed liquid and fiber furnish, also referred to herein as foamed fiber furnish. This foamed fiber furnish is very difficult to meter accurately on a dry fiber basis before it is added to the forming loop.

SUMMARY OF THE INVENTION

In the process of this invention, the foamed fiber furnish is made up from an aqueous slurry of natural or synthetic fibers or mixtures of fibers and foamed liquid carrier just prior to its introduction to the headbox. The pulp slurry supplied to the system has a consistency in the range of only about 0.5 to about 7 weight percent fibers, preferably in the range of from about 2.5 to about 4.5 weight percent. The pulp slurry is added to a foamed liquid comprising water, air and surfactant containing 55 to 80 percent air by volume forming a foamed fiber furnish having a consistency in the range of from about 0.1 to about 3 weight percent fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom by the method disclosed in a coassigned, copending patent application of Dinesh Bhat filed concurrently herewith.

DETAILED DESCRIPTION OF A PREFERRED EMBODIMENT

Figure 1:
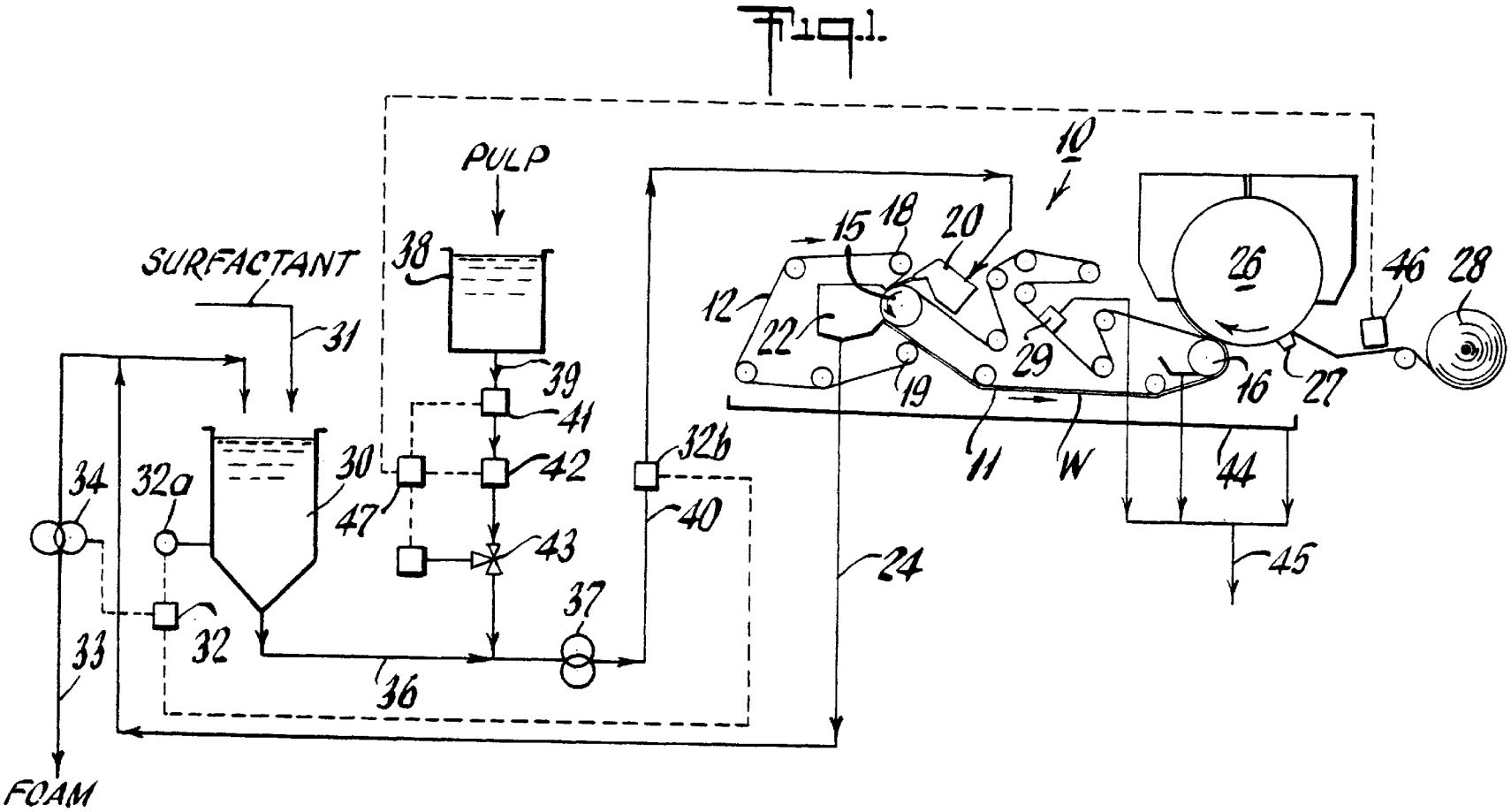
FIG. 1 is a diagrammatic elevational view of a preferred embodiment of apparatus for carrying out the process of this invention.

With reference to FIG. 1, papermaking machine 10, known in the art as a crescent former, corresponds to that described in U.S. Pat. No. 3,326,745, incorporated herein by reference. The web-forming end or wet end of the papermaking machine includes a liquid permeable forming support such as, for example, felt or fabric 11 and a pressing wire or screen 12 of the type used in the art for wet forming of nonwoven webs. Forming felt 11 is also referred to hereinafter as a forming support means or as a papermaking felt. Forming felt 11 is suitably constructed of synthetic filament woven mesh base with a very fine synthetic fiber batt attached to the mesh base. The forming felt is supported in a conventional manner on rolls including breast roll 15 and couch roll or pressing roll 16.

Pressing wire 12 is similarly supported on rolls including rolls 18 and 19 which are so positioned relative to breast roll 15 as to cause the pressing wire 12 to converge on the forming felt 11 at the cylindrical breast roll 15 at an acute angle relative to felt 11. The felt 11 and wire 12 move in the same direction at the same speed and in the direction of rotation of breast roll 15. In this machine, wire 12 and forming felt 11 converge at the upper surface of forming roll 15 to form a wedge shaped space or nip into which a jet of a foamed fiber furnish is directed from a pressurized headbox 20. Wire 12 is so tensioned that as it passes over the felt 11 on the surface of breast roll 15, the foamed liquid-fiber dispersion is pressed between wire 12 and felt 11 forcing fluid through wire 12 into saveall 22 where it is collected as foamed liquid having an air content in the range of 50 to 80 percent by volume for reuse in the process. The wet web W formed in the process is carried by felt 11 to pressing roll 16 where it is transferred to the drum 26 of a Yankee dryer. Fluid is pressed from the wet web by pressing roll 16 as the web is transferred to the drum 26 of the dryer where it is dried and creped by creping blade 27. The finished web is collected on take-up roll 28. It will be evident that some of the surfactant necessary to form the foamed aqueous liquid used in the process normally remains in the web.

Foamed liquid collected from the foamed fiber furnish in saveall 22 is returned through line 24 to foam silo 30. White water from pit 44, Uhle box 29 and pressing roll 16 may be combined in flow line 45 and separately processed for recovery of surfactant and fibers from the fluid.

Concentrated surfactant is added to the foam silo 30 through line 31 as required to make up losses from the system. A substantially constant inventory of foamed liquid is maintained in the foam silo 30 by indirectly regulating the rate of flow from line 24 to silo 30. Excess foamed liquid is drawn from line 24 by pump 34 and discharged through line 33 at a rate determined by pump speed controller 32 responsive to signals from pressure sensor 32*a* at the base of silo 30 and from density meter 32*b* in line 40.

Dwell or retention time in the silo is preferably in the range of from about 30 seconds to 1 minute. Foamed liquid is withdrawn from foam storage silo 30 through line 36 to a positive displacement fan pump 37. A pulp slurry containing of the order of 0.5 to 7 weight percent fiber, preferably in the range of from about 2.5 to about 4.5 percent fiber, is drawn from machine chest 38 through line 39 and in this preferred embodiment is added to the foam from line 36 at the inlet to the fan pump 37 in the amount necessary to form the foamed-fiber furnish of the desired consistency in the range of from about 0.1 to about 3 weight percent, preferably in the range of 0.3 to 1.2 weight percent, for the production of fibrous web on the forming felt 11. The rate of pulp feed to the fan pump is controlled by valve 43 responsive to controller 47 which receives signals from basis weight meter 46, consistency meter 41 and flow meter 42, all of conventional design to produce webs of the desired basis weight at the production speed of the felt 11 on machine 10. Typical basis weights of the uncreped web are in the range of from about 4 pounds per 3000 square foot ream to about 35 lb/rm or more. Preferred basis weights are those within the range of from about 6 to about 25 lb/rm. From the fan pump 37, the foamed-fiber furnish is delivered through line 40 to the headbox 20 of the papermaking machine.

In a preferred embodiment of the process of this invention, water from a suitable source, not illustrated, is added to the foam silo 30 with sufficient surfactant to produce the desired foamed liquid. For example, an aqueous solution of a suitable anionic surfactant, such as an alpha olefin sulphonate, available from Witco Chemicals, Inc., New York, N.Y. may be used to produce a satisfactory aqueous foam at a preferred concentration in the range of from about 100 ppm to about 350 ppm by weight. A number of surfactants suitable as a water additive for purposes of the present invention are available on the market, being generally classified as nonionic, anionic, cationic, or amphoteric. The surfactant concentration required usually will be in the range of 150 to about 1000 ppm by weight. A preferred nonionic surfactant is a peg-6 lauramide marketed under the tradename Mazamide L-5AC by Mazer Chemical Co., Chicago.

Selection of a class of surfactant is dependent upon chemical characteristics of such other additives as may be commonly used in the manufacture of fibrous webs. These other additives include, singly or in homogeneous mixtures thereof, latexes, binders, debonding agents, dyes, corrosion inhibiting agents, pH controls, retention aids, creping aids, additives for increasing wet strength or dry strength as well as other substances commonly used in papermaking processes.

U.S. Pat. Nos. 3,716,449 and 3,871,952 disclose specific nonionic, anionic, and cationic surfactants, including some classified as amphoteric surfactants, which are suitable for practice of the present invention. The disclosures of these patents are included by reference in the present application for their teachings of surfactant materials. It is to be understood that there are a number of other surfactant materials available which are capable of modifying the interfacial tension between water and gas or air to form a semi stable foam suitable as aqueous carrier medium suitable for use in the process of this invention.

A preferred method of generating the aqueous foam as the carrier of the fibers in the furnish is that disclosed in U.S. Pat. No. 4,443,299. As a specific example, foam carrier liquid is initially gerated by driving the forming felt 11 and wire 12 at a speed of about 2500 feet per minute (fpm), with the tension of the wires adjusted to a range of from about 20 pli (pounds per linear inch) to about 60 pli, suitably about 30 pli. Variable speed, positive displacement fan pump 37 is energized to pump a water-surfactant solution, or foamable liquid, from silo 30 to pressurized headbox 20, from which a foamable liquid jet is directed to the nip formed at the juncture of the forming felt 11 and wire 12. The pressure of the foamed liquid (and foamed liquid-fiber furnish) delivered to headbox 20 from pump 37 usually will be within the range of from about 5 to about 100 pounds per square inch gauge (psig). The pressure and flow rate of the liquid are regulated to achieve a jet velocity of from about 90% to about 150% of the speed of the forming felt both during foam formation and web formation. Preferably, the speed of the jet is about 110% of the speed of the forming felt 11. Forming felt speeds in the range of from about 1000 fpm to about 7000 fpm or more may be employed in the formation of the web W.

As the foamable liquid impinges on the forming felt 11, it is distributed over its surface, and the pressure created as the outer wire 12 moves onto the felt 11, combined with the force of liquid jet from the headbox 20 on the outer wire, causes the foamable liquid to flow through interstices of outer wire 12 into the saveall 22. Closure of the wire 12 on forming felt 11, together with their linear movements and the force of impingement of liquid jet thereon, cooperate to produce combined compressive and shear forces on the foamable liquid passing through wire 12 sufficient to entrain air traveling with the wire 12 and felt 11 as well as air in their interstices, and to generate the desired foamed liquid.

Foamed liquid is collected in saveall 22 and returned to the upper region of silo 30 by way of conduit 24. Foamable liquid and foamed liquid is pumped again, in a continuous cyclic manner from the silo 30 by fan pump 37 to headbox 20 for passage through wire 12 and return to the silo until the desired consistency of foamed liquid is obtained. Typically, over an operating period of about 12 to 30 cycles of circulation of foamed liquid and foamable liquid through the system, the air content of the liquid is increased from almost nil to a preferred value in the range of from about 60 to about 70 percent air by volume with a maximum bubble size, for example, in a range from about 20 microns to about 200 microns, i.e. of a size less than the lengths of the fibers which are used in the furnish. Optimum relationships of bubble dimensions to fiber dimensions are dealt with in the referenced U.S. Pat. Nos. 3,716,449 and 3,871,952 and are preferred in the process of the present invention.

As pointed out hereinabove, the pulp slurry supplied to the system from machine chest 38 introduces water into the system at a greater rate than that of the rate of water removal from the system by the wet web. The excess water is removed from the process as foamed liquid through line 33. The water contained in the foamed liquid leaving the system through line 33 may be used as such in other processes or treated for removal of surfactant therefrom before it is discharged into a pond or stream to avoid pollution of the environment. A preferred method of treatment of the excess foamed liquid is disclosed in a coassigned, copending patent application of Dinesh Bhat filed concurrently herewith. In this preferred embodiment, the quantity of excess foamed liquid discharged from the system is controlled by pump 34 in line 33 in response to a pressure sensor 32 at the base of silo 30.

The air content of the foamed liquid is maintained within the desired range by varying the concentration of the surface active agent in the foamable aqueous carrier liquid which comprises air, water, and surfactant. Some of the surfactant is continuously removed from the system in the finished web. The wet web at the point of its transfer from felt 11 to drum 26 contains foamable liquid. Drying of the web on drum 26 removes water from the web leaving some surfactant. Makeup surfactant is added as required through line 31 to silo 30. The properties of the foamed liquid are dependent on air content in the range of from about 55 to 80 percent air by volume; the bubble size at atmospheric pressure being in the range of from about 20 to about 200 microns in diameter; and the concentration of the selected surfactant.

Because of the head induced by the pump 37, the bubble size of the foamed liquid in the headbox is reduced, the average bubble size therein typically being in the range of about 5 to about 100 microns. The bubble size increases as pressure is decreased during passage of the foamed liquid through line 40. The pressure drop through nozzle 20 is generally in the range of about 5 to 100 psi (pounds per square inch), and is a function of the jet velocity required. As the foam expands across the nozzle, the bubbles become larger, the density of the foam decreases and the viscosity of the foam increases. The fibers are distributed randomly but uniformly between the felt 11 and wire 12 to produce a web having a high degree of uniformity of fiber distribution as indicated by standard tests and visual inspection of the web.

Figure 2:
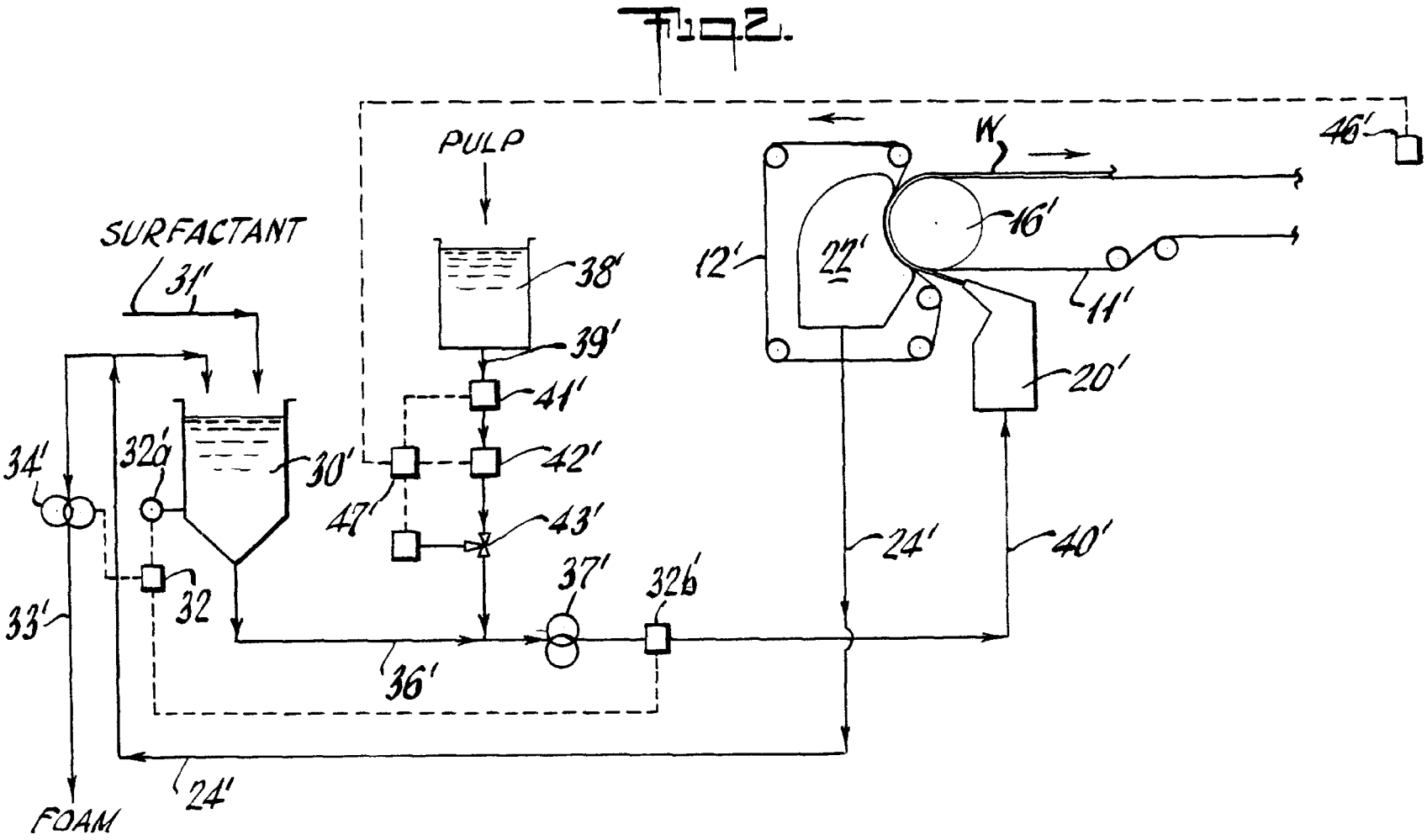
FIG. 2 is a diagrammatic elevational view of an alternate embodiment of apparatus for carrying out the process of this invention.

FIG. 2 illustrates the process of this invention as applied to a twin wire machine. In this instance, the numeral 11' refers to the forming wire and the numeral 12' to the pressing wire. Pressurized headbox 20' injects a jet of foamed furnish into a nip formed between wires 11' and 12' on the lower surface of breast roll 16'. Such twin wire machines are well known in the art and are described in greater detail in U.S. Pat. No. 4, 543,156.

As illustrated in FIG. 2, foamed liquid from saveall 22' flows through line 24' to silo 30'. Surfactant solution is supplied as required through line 31' to maintain the required air content of the foam in the system as described hereinabove. A substantially constant inventory of foamed liquid is maintained in silo 30' by controller 32' activating pump 34'. Excess foamed liquid is discharged through line 33'. Low consistency pulp slurry is supplied from machine chest 38' as determined by flow control valve 43' responsive to controller 47' in response to signals from basis weight meter 46' which measures the basis weight of the dried web W and from consistency meter 41' and flow meter 42'. The pulp slurry is introduced into foamed liquid from silo 30' in line 36' near the inlet to fan pump 37'. The resultant foamed fiber furnish flows through line 40' directly to pressurized headbox 20'. Thus, the system functions in the same manner as that described hereinabove with reference to FIG. 1.

EXAMPLE

A foam-formed web is produced on a crescent former papermaking machine, one foot wide, operated at 3000 feet per minute to produce a 9.3 pounds per 3000 square foot ream web from wood papermaking fibers. One thousand gallons per minute (gal/min) of forming foam containing 62 volume percent air and 380 gal/min water containing 300 ppm surfactant with a consistency of 0.31 percent, based on the dry weight of the fibers, is supplied to the forming wires. Fifteen gallons per minute of surfactant-containing liquid leaves the system in the web. Air is entrained in the liquid displaced from the web at the rate of 19 gallons (about 2.54 cubic feet) per minute, regenerating the foam. Excess foam discharged from the system removes water at the rate of 11 gal/min which is replaced by 26 gal/min entering with the pulp slurry. The pulp slurry consistency is 3.5 weight percent. Makeup surfactant is added as required to maintain the desired concentration of 300 ppm (about 3.9 pounds surfactant per hour). The resultant web is dried and creped on a yankee drum drier forming a high quality web containing a small amount of residual surfactant.

Visual and tactile inspection of the web using standard industry test methods as compared with water laid webs formed on the same machine confirmed superiority of the web formation resulting from the process of this invention.

While the process of this invention has been described herein applied to the formation of the web on a specific type papermaking machine it is to be understood that the process of the invention may be applied equally well to web formation on a flat wire, inclined wire, or suction breast roll machine. It will be appreciated by those skilled in the art that the process of this invention has a number of advantages over those of the prior art in eliminating the need for dewatering the feed pulp and the subsequent need for high energy repulping with foamed liquid for the preparation of the foamed fiber furnish. Among its many advantages are the ability to control accurately the fiber flow rate with conventional pulp consistency meters and flow meters and the ability to make basis weight changes quickly and accurately. The process may be used for wet forming of fibrous webs from an unfoamed aqueous furnish without modification except for discontinuing the surfactant feed to the process. It will be evident that this improved process eliminates much of the equipment required for foam forming as compared with the prior art processes, such as mixing tanks, high shear mixers, turbulence generators, Denver cells, and the like.

What is claimed is:

1. Apparatus for making a fibrous web or tissue comprising:

(i) a moving foraminous support;

(ii) slurry supply means for supplying an aqueous slurry of fibers maintained at a consistency of from about 0.5 to about 7 weight percent fibers based on the dry weight of the fibers;

(iii) foam supply means for supplying a foamed liquid comprising water, air and a surface active agent containing from about 50 to about 80 percent air by volume;

(iv) furnish makeup means for combining said aqueous slurry of fibers with said foamed liquid to form a foamed fiber furnish containing from about 50 to about 80 percent air by volume in an amount sufficient to form a foamed fiber furnish containing from about 0.1 to about 3 weight percent fibers based on the dry weight of the fibers, said furnish makeup means including a supply line from said slurry supply means and a supply line from said foam supply means operatively connected to a positive displacement pump, and consistency determining means for measuring the consistency of said aqueous slurry of fibers and flow rate determining means for measuring the flow rate of said aqueous slurry of fibers being operatively connected to said supply line from said slurry supply means;

(v) means for depositing said foamed fiber furnish on said foraminous support in an amount sufficient to form a fibrous web;

(vi) mass sensitive means for measuring the basis weight of said web; and (vii) furnish consistency control means being operatively connected to and responsive to said flow rate determining means; said mass sensitive means and to said consistency determining means for producing a signal for actuating a valve operatively connected to said supply line from said foam supply means for controlling the flow rate of said aqueous slurry of fiber into said furnish makeup means.

2. The apparatus according to claim 1 further comprising means for maintaining the air content of the foamed liquid in the range of from about 60 to about 70 percent air by volume.

3. The apparatus according to claim 1 further comprising means for collecting foamed liquid subsequent to deposition of foamed furnish on said foraminous support wherein collected foamed liquid removed from the web is returned as a source of foamed liquid for combining with said foam supply means.

4. The apparatus according to claim 1 wherein said furnish consistency control means controls the flow rate of aqueous slurry of fibers such that the dry basis weight of the uncreped web is maintained in the range from about 4 to about 35 pounds pet 3000 square foot ream.

5. The apparatus according to claim 1 wherein said furnish consistency control means controls the flow rate of aqueous slurry of fibers such that the dry basis weight of the web is in the range from about 6 to about 25 pounds per 3000 square foot ream.

6. The apparatus according to claim 1 wherein said furnish consistency control means maintains the consistency of the aqueous slurry in the range of from about 2.5 to about 4.5 weight percent fiber.

7. The apparatus according to claim 1 wherein said furnish consistency control means maintains the consistency of the foamed fiber furnish supplied to the foraminous support in the range of from about 0.2 to about 1.2 weight percent fiber.

8. The apparatus according to claim 1 wherein the foraminous support is a papermaking felt.

9. Apparatus for the preparation of a fibrous web from a foamed aqueous dispersion of natural or synthetic fibers or both which comprises in combination:

a papermaking machine comprising a forming support, a headbox for distribution of a foamed fiber furnish on the forming support to form a wet web, a pressing wire for expressing liquid from the wet web with formation of foamed liquid by squeezing the web between the pressing wire and the forming support and means for recovering foamed liquid therefrom;

a storage tank for foamed liquid; a pressure sensor for measuring the pressure within said storage tank and generating a signal;

means for delivering foamed liquid from the storage tank to the headbox of the papermaking machine;

means for combining a water slurry of fibers with said foamed liquid forming a dispersion of fibers in foam as said foamed fiber furnish supplied to said headbox; and means for maintaining a constant inventory of foamed liquid in said storage tank and for discharging excess foamed liquid recovered from the foraminous support including control means being operatively connected to and responding to signals from a) said pressure sensor, and b) means for determining the density of the foamed liquid between the storage tank and the headbox for operating a pump for discharging excess foam liquid from said storage tank.

* * * * *

UNITED STATES PATENT AND TRADEMARK OFFICE

CERTIFICATE OF CORRECTION

PATENT NO. : 6,413,368 B1
DATED : July 2, 2002
INVENTOR(S) : Dwiggins et al.

It is certified that error appears in the above-identified patent and that said Letters Patent is hereby corrected as shown below:

Column 7,
Line 20, “pet” should read -- per --.

Signed and Sealed this

Third day of September, 2002

*Attest:*

*Attesting Officer*

JAMES E. ROGAN
*Director of the United States Patent and Trademark Office*